United States Patent [19]

Venetucci

[11] 4,428,535

[45] Jan. 31, 1984

[54] APPARATUS TO COOL PARTICULATE MATTER FOR GRINDING

[75] Inventor: Jim M. Venetucci, Forest Park, Ill.

[73] Assignee: Liquid Carbonic Corporation, Chicago, Ill.

[21] Appl. No.: 280,882

[22] Filed: Jul. 6, 1981

[51] Int. Cl.[3] ..... B02C 13/286

[52] U.S. Cl. ..... 241/35; 241/65; 241/186 A; 241/DIG. 37; 366/296

[58] Field of Search ..... 222/240; 366/97, 83, 366/293, 294, 295, 296, 320; 241/DIG. 37, 34, 73, 101 B, 186 A, 65, 35

[56] References Cited

U.S. PATENT DOCUMENTS

| | | | |
|---|---|---|---|
| 3,186,602 | 6/1965 | Ricciardi | 222/161 |
| 3,439,836 | 4/1969 | Ricciardi | 222/200 |
| 3,452,965 | 7/1969 | Leister | 366/293 X |
| 3,761,024 | 9/1973 | Schwey et al. | 241/34 X |
| 3,771,729 | 11/1973 | Frable | 241/DIG. 37 X |
| 3,897,010 | 7/1975 | Weishaupt | 241/5 |
| 3,992,889 | 11/1976 | Spahn | 62/374 |
| 4,232,973 | 11/1980 | Ligouzat | 366/296 X |

*Primary Examiner*—Mark Rosenbaum

*Attorney, Agent, or Firm*—Fitch, Even, Tabin & Flannery

[57] ABSTRACT

In an insulated mixing and cooling chamber having a feed auger to deliver cooled particles to a grinder and an intromitter auger rotatable around the feed auger to mix the particles within the chamber, independent variable speed, reversible motors operate the intromitter and feed augers, whereby the relative rotation of the augers may be precisely adjusted even while the mixing apparatus and associated grinding apparatus are operating. Electronic and or pneumatic control of cryogenic liquid inflow, as well as electronic control of the auger drive motors, may be used to optimize cooling and mixing conditions.

21 Claims, 2 Drawing Figures

APPARATUS TO COOL PARTICULATE MATTER FOR GRINDING

The present invention is directed to particulate material mixing and cooling systems and more particularly to systems in which heat sensitive particulate material is cooled to low temperatures to be ground, e.g., in a brittle state.

BACKGROUND OF THE INVENTION

For a wide variety of processes from recycling old rubber, to preparing thermoplastics for molding, to powdering chili peppers, it is desirable to reduce particulate material to very fine mesh. If soft or resilient particles are cooled until they are brittle, they may be efficiently fragmented. To cool the particles to where they are brittle, the particles may be sprayed or soaked in cryogenic liquids in apparatus such as those described in U.S. Pat. Nos. 3,992,899, 3,990,641 and 3,897,010. The cold brittle particles may be ground, e.g., in an impact grinder, into tiny mesh fragments. The ground fragments may be shifted through screens of appropriate mesh to obtain particle fragments of a desirably small size.

A persistant problem with apparatus that cools particles to brittleness and grinds the cold, brittle particles is non-uniformity of cooling and/or subsequent heating of particles in the grinding apparatus whereby non-brittle particles are processed in the grinder. Soft or resilient particles are not adequately fragmented in the grinder and tend to clog up both the grinder and the subsequent screening apparatus. The need exists for improved cooling and mixing apparatus which assures complete cooling of all particles to a temperature at which they will be brittle and from which they will not heat up sufficiently in the grinding apparatus to soften.

In other applications, even where cooling is not necessary to maintain the material being ground in a brittle state, it is desirable to introduce the material into the grinder at a very low temperature to prevent deterioration of the product. For example, it is desirable to precool freshly roasted coffee beans to 40° C. prior to grinding so that the grinding process does not heat the beans sufficiently to result in deterioration of the oil or escape of aromatic substance to the atmosphere.

Apparatus for dispersing particulate material having an outer mixing or intromitter auger rotatable around a central feed auger have been described previously in U.S. Pat. Nos. 3,186,692 and 3,439,836. The relative speed of the two augers is adjustable through gear reducer mechanisms to which the augers are commonly linked. When the augers are linked by gear reducer mechanisms, the available relative rotation ratios are normally fixed or limited by the number of gear wheels, and it may be difficult to optimize mixing and feeding conditions. Normally, the intromitter and feed augers of precoolers are driven by variable speed drive motors, but are linked by gears which drive the augers at a fixed ratio of rotation rates, e.g., a 2:1 ratio of the speed of the intromitter auger to the speed of the feed auger. While the speed of the augers can be easily changed by changing the speed of the motor, the ratio of their speeds can be only changed by replacing the linking gears. It is desirable that precooling apparatus have versatility whereby ratios of rotation rates of the augers can be easily adjusted during operation. It may, for example, be desirable to adjust the mixing and feed rates as the temperature in the chamber changes, e.g., after the start-up of operation. It may also be desirable to change the relative rotation of the augers to adjust for variations in the particulate material which is fed into the chamber.

DETAILED DESCRIPTION OF THE PREFERRED EMBODIMENT

Figures 1, 2:
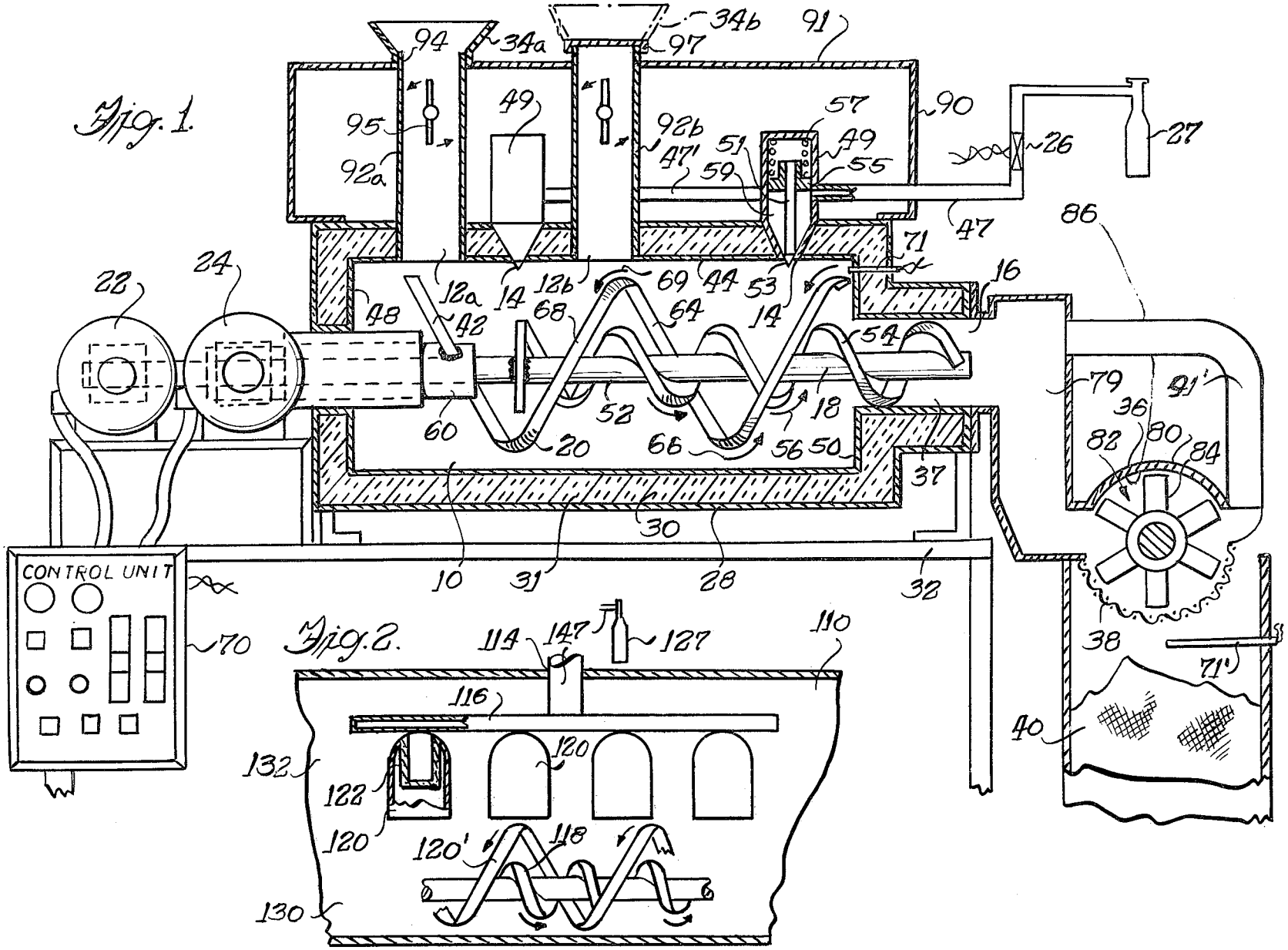
FIG. 1 is a cross-sectional view of a cooling and mixing chamber embodying various features of the invention and shown in conjunction with associated control and grinding apparatus.
FIG. 2 is a diminutive cross-sectional view of an alternative embodiment of a mixing chamber having alternative cryogenic inlet apparatus.

A mixing and cooling chamber 10 has particle inlet openings 12*a*, 12*b*, a cryogenic liquid inlet opening(s) 14, a particle outlet opening 16, a rotatable feed auger 18 to deliver cooled particles through the particle outlet opening and a mixing or intromitter auger 20 rotatable therearound to mix the particles. In accordance with the present invention, the feed and intromitter augers are driven by independent variable speed motors 22, 24, respectively, which are controlled, e.g., electronically, to allow precise and continuous adjustment of the relative rotations of the augers. These independent variable speed motors provide an infinite number of speed conditions for both the feeding and intromitter augers 18, 20. As a means to adjust the temperature within the chamber 10, a cryogenic liquid injection valve 26, which determines the input of cryogenic liquid e.g., liquid, nitrogen or liquid carbon dioxide, into the chamber 10 from a source of cryogenic liquid 27 is controlled, e.g., electronically or pneumatically, so that it too may be precisely and continuously adjusted. An outer shell 28 around the chamber 10, provides a space 30 filled with insulation 31, e.g., urethane foam.

The mixing chamber 10, which is mounted on an elevated platform 32, is supplied with particulate material from hoppers 34*a*, 34*b*. The particulate material, which falls from the hoppers 34 through the inlet openings 12*a*, 12*b* in the upper end of the chamber 10, is mixed by the intromitter auger 20 and fed through the tubular outlet passageway 37 to an impact grinder 36 disposed at the downstream end of the outlet passageway. Particles or powders of sufficiently fine mesh fall through a grid or screen 38 at the lower end of the grinder 36 into a collecting bin 40.

The elongated cooling and mixing chamber 10 is preferably cylindrically shaped so that the blade 42 of the intromitter auger 20, which is closely matched in diameter to the interior wall 44 of the chamber, contacts particles along the wall, preventing stagnation of particles within the chamber. A first particle inlet opening 12*a* is disposed closely adjacent the upstream end 48 of the chamber, and a second particle inlet opening 12*b* is disposed generally midway between the ends of the chamber 10 and will be used when it is desired to supply particulate material to the chamber at a faster rate or when it is desired to feed two types of particulate material into the chamber simultaneously to be mixed and ground together. For most applications, however, the particulate material will be introduced through the upstream inlet opening 12*a*. The second inlet opening 12*b* may also serve as a vent for gas which results from vaporization of the cryogenic liquid.

The conduit 47, through which cryogenic liquid is transferred from the source 27 to the chamber 10, preferably has a manifold section 47' extending along the top of the chamber 10 carrying a plurality of inlet devices 49 which extend through inlet openings 14 of the chamber. The nozzle device 49 may take the form of a simple orifice, a sintered metal phase separator or a controlled needle valve, etc. In the embodiment shown in FIG. 1, the device 49 takes the form of a needle valve in which a needle 51 moves upwardly and downwardly to incrementally open and close a constricting orifice 53. The needle 51 is connected to a piston 55 which is biased downward by a spring 57 and upward by pressure in a lower chamber 59 as determined by the modulating valve 26. The needle valve 49 provides for dispersion of the cryogenic liquid into fine sprays over a wide range of liquid pressure.

The feed auger shaft 52 extends from outside the upstream end 48 of the chamber 10, through the chamber and through the tubular outlet passageway 37 which is matched in diameter to the diameter of the feed auger blade 54. The feed auger blade 54 spirals around the shaft 52 and extends from within the chamber 10 to the downstream end of the shaft 52 in the outlet passageway 37. The feed auger blade 54 is pitched to move the particles downstream and through the outlet opening 16 when the auger 18 is rotated in the direction of the arrows 56 (close thereby in reference to FIG. 1). The feed auger blade 54 is preferably solid from its shaft 52 outward to prevent blow back of cold gas and/or particles from the grinder 36.

The intromitter auger shaft 60, which extends from just outside the upstream end 48 of the chamber 10 and terminates inside the chamber closely adjacent the upstream end, is disposed around the feed auger shaft 52 and rotates coaxially and independently of the feed auger shaft. The blade 42 of the intromitter auger 20 is supported from the end of its shaft 60 for rotational movement around and coaxial with the feed auger blade 54. One surface 64 of the intromitter auger blade 42 has a pitch which tends to move the particles downstream when the auger 20 is rotated in the direction of the arrows 66 (at the bottom of the chamber 10 in FIG. 1) while the other surface 68 of the intromitter auger blade has a pitch which tends to move the particles upstream in a countercurrent to the feed auger 18 when the intromitter auger is rotated in the direction of the arrows 69 (shown in FIG. 1 at the top of the chamber).

An important feature of the apparatus is the use of the first motor 22 to independently drive the feed auger 18 and the second motor 24 to independently drive the intromitter auger 20. The use of two variable speed motors 22, 24 provides flexibility of rotational adjustment not found in previous mixers in which a single motor drives both augers that are interconnected by gear reducing mechanisms. Each motor 22, 24 is a variable speed motor and controlled independently by the common control unit 70, whereby the speed may be adjusted to any speed within a range. In a typical precooler arrangement, the feed auger 18 is connected to a 1750 r.p.m. maximum variable speed motor 22 with a gear reduction ratio of 30 to 1 and rotates in either direction from 1 to 116 r.p.m., and the intromitter auger 20 is connected to a 1750 r.p.m. maximum variable speed motor 24 with a gear reduction ratio of 1 to 15 and rotates in either direction from 1 to 25 r.p.m. Either auger 18, 20 may operate while the other is stationary. Higher speeds may, of course, be achieved with faster motors and/or appropriate gears. By operating the intromitter and feed augers 20 and 18 independently, the rate of mixing is independent of the rate of feed. Thus, when it is necessary or desirable to reduce or stop the rotation of the feed auger 18, e.g., to prevent overloading of the grinder 36, the intromitter auger 20 may continue to be rotated at a speed for optimal cooling and mixing.

The motor 24 or the linkage of the motor to the intromitter auger shaft 60 provides for rotation of the shaft 60 in either direction as determined by the control unit 70. Although the feed auger 18 will generally be operated in a single direction 56 which delivers the particles downstream, its motor 22 preferably is also reversible for times when it is desired to retain the particles within, but mixing, in the chamber 10, e.g., when unloading the collection bin 40.

The control unit 70, which controls the motors 22, 24 also controls the cryogenic liquid injection valve 26 determining the inflow of cryogenic liquid, allowing an operator to precisely adjust the rotation of the augers 18, 20 and temperature as determined by input of cryogenic liquid during operation of the apparatus to arrive at the optimal conditions for cooling and mixing. Achieving optimal conditions of cooling rate, mixing rate and feed rate is dependent on the peculiarities of the mixing apparatus, the grinding apparatus and the size and nature of the particles, and achieving the optimal conditions may be best accomplished by the fine adjustment of a skilled operator rather than according to a predetermined formula. Furthermore, conditions such as particle size, texture etc. may change during a run, and hence the need to continually adjust for optimal conditions. The need for flexibility may be particularly important in experimental runs where optimal conditions are being determined for cooling and feeding a new type of particulate material. The control unit 70 may also be programmable to adjust the mixing rates according to the temperature of particles in the chamber 10, the amount of material in the grinder 36 and the temperature of the final product within the bin 40. The temperature within the chamber 10 is sensed by a probe 71 which extends into the downstream end 50 of the chamber and is preferably connected to the control unit 70 for opening and closing the cryogenic liquid valve 26 according to the temperature in the chamber. An additional optional temperature sensing device 71" is located within the grinder housing near the discharge side of the grinder and connected to the control unit 70 to aid in determining the optimal flow of the cryogenic liquid. If the temperature of the ground particles is well below the maximum desirable temperature, the inflow of cryogenic liquid into the chamber 10 may be reduced. The amount of resistance experienced by the grinder motor, which can be measured by electrical current in amperes, may provide one method of measuring the amount of material in the grinder 36, and appropriate circuitry in the control unit 70 may automatically adjust the speed of the feed auger 18 according to the amount of material in the grinder.

In the embodiment shown in FIG. 1, the outlet passageway 37 opens into a chute 79 through which cooled particles fall to a grinding chamber 80 of an impact grinder 36. The illustrated grinding chamber 80 is cylindrical gases an axis which is transverse to the axis of the mixing chamber 10. A grinding member 82, having a plurality of radially extending hammers 84, is rotated within the cylindrical chamber 80 to fragment the particles between the hammers and the wall 86 of the chamber. The lower portion of the wall 86 is the arcuate grate or screen 38 of predetermined mesh. The screen 38 may be changed depending on the grinding application to determine the size of the particle fragments which fall through the screen and into the bin 40. A return conduit 91' returns gasses from the grinder 36 to the chamber 10.

While the brittle particles are easily fragmented in the grinder 36, a good deal of heat of friction is generated thereby which tends to heat up the particles, and for efficient grinding, it is necessary that the particles be fragmented before they are heated to a transition temperature whereat they soften. If the particles are not sufficiently cooled, they will not fragment sufficiently and will clog up the screen 38 backing up material in the grinder 36. Accordingly, all of the particles entering the chamber 10 are cooled evenly to a temperature well below their transition temperature. Of course, the temperature required to maintain brittleness throughout the grinding process and the time required in the mixing chamber 10 to achieve this temperature varies according to the nature of the particles and their initial size. The versatile apparatus, described herein, provides for adjusting the conditions according to the material and permits accommodation for changes in the material, e.g., size, which may occur during the operation of the apparatus. Very large particulate material may be fed very slowly through the outlet passageway 37 by a very slowly rotating feed auger 18, and the intromitter auger 20 may be run in the direction 69 which tends to move the particles upstream. For particles which are relatively tiny to begin with, the feed auger 18 may be run relatively fast and the intromitter auger 20 rotated in the direction 66 which tends to move the particles downstream to where they are instantaneously cooled to cryogenic temperatures by the spray of cryogenic liquid at the downstream end 50 of the chamber 10.

As an example of a grinding application facilitated by the versatility of the apparatus provided herein, it may be desirable to produce superfine particle fragments from relatively large particles. Because there are practical limits to the fineness of the screen 38 mesh which may be used at the lower end of the grinder 36, the ground particle fragments may be reshifted, and the coarser particle fragments returned to the hopper 34 for additional grinding. At the beginning of the run when large particles are introduced into the hopper 34, the particles may be retained in the chamber 10 a relatively long time to insure even cooling. When the coarsely ground particle fragments are reintroduced, it is efficient to run the fragments through the chamber 10 at a much faster rate.

The cryogenic liquid inlet valve 26 and associated actuating apparatus may be disposed in an optional housing 90 (FIG. 1) mounted over the shell 28. Tubular conduits **92*a,b* extend from the top 91 of the housing 90 through the shell 28 and into the inlet openings 12*a,b* of the chamber 10. The hoppers 34*a,b* are removably attachable to the upper ends 94 of the inlet conduits 92*a,b* which extend from the top 91 of the housing 90. Preferably, the inlet conduits 92 are valved 95, e.g., with rotary valves or air lock valves, to control the feed into the chamber 10 from the hopper(s), and the valving mechanism, actuated by the control unit 70, is also disposed inside the housing 90. If the second hopper 34*b* is not being used, the central conduit 92*b* may be capped by an insulating cover 97 or used as a vent for the removal of gases from the chamber. When used as a vent, the valve 95 in the central conduit 92*b* serves to prevent the escape of particulate material from the chamber 10. In addition to protecting the mechanisms which control input into the chamber and liquid nitrogen input, the housing 90 serves an insulating function, reducing thermal transfer through the inlet openings 12. If an optional housing 90 is not employed, the hoppers 34** and cryogenic inlet apparatus are separately insulated.

Illustrated in FIG. 2 is an alternative embodiment of a chamber 110 having an alternative embodiment of a cryogenic inlet assembly. The conduit 147 from the supply of cryogenic liquid 127 extends through an opening 114 at the upper end of the chamber 110 and is connected to an inlet manifold 116, and a plurality of spray nozzles 120 extend therefrom. A preferred spray nozzle 120 is of the type described in U.S. Pat. No. 3,295,563 in which the cryogenic liquid is introduced through a porous throttling element 122 that diffuses a stream of liquid into many fine low velocity streams. Such a porous element 122 may be formed of sintered metal.

In order to accommodate the internal inlet manifold 116, the chamber 110 is upwardly elongated. The lower portion 130 of the chamber is semicylindrical, but the upwardly elongated upper portion 132 may be otherwise shaped, e.g., rectangular, because particles tossed into the upper portion fall back into the lower portion where they are picked up by the feed auger 118 or by the intromitter auger 120' which rotates closely along the semicylindrical surface.

While the invention has been described in terms of certain preferred embodiments, modifications obvious to one with ordinary skill in the art may be made without departing from the scope of the invention. For example, various other types of grinders, e.g., airswept mill, attrition mill, pin mill, stud mill, etc., may be used in conjunction with the mixing chambers 10, 110.

Various features of the invention are set forth in the following claims.

What is claimed:

1. Apparatus for mixing and cooling particulate material comprising an elongated mixing chamber having particulate material inlet means, cryogenic liquid inlet means connected to a supply of cryogenic liquid and disposed downstream of said particulate material inlet means to spray cryogenic liquid on the particulate material, and particulate material outlet means at the downstream end of said chamber through which cooled particulate material is delivered, feed auger means having a shaft and a blade supported thereby, said feed auger means being disposed in said chamber and rotatable about an axis to move cooled particulate material through said chamber and through said outlet means, intromitter auger means coaxial with said feed auger means having a shaft rotatable independently of the rotation of said feed auger shaft and a blade supported by said intromitter auger shaft and disposed around said feed auger blade, first variable speed drive means connected to said feed auger shaft to rotate the same, second variable speed drive means connected to said intromitter auger shaft to rotate the same, said second variable speed drive means being operable to rotate said intromitter auger means in either rotational direction, a first surface of said intromitter auger blade being configured to move particles within said chamber in a downstream direction when said intromitter auger shaft is rotated in a first direction and a second surface of said intromitter auger blade being configured to move particles within said chamber in an upstream direction when said intromitter auger shaft is rotated in a second direction, and control means is connected to said first variable speed drive means for operating said first drive means during certain times at a desired feed rate and for operating said first drive means during other times to prevent feeding of particulate material when additional residence time of particulate material within said mixing chamber is required, and is also connected to said second variable speed drive means for operating said second drive means independently of said first drive means, providing for independent adjustment of the speed and direction of rotation of said feed auger means and said intromitter auger means.

2. Apparatus according to claim 1 including a valve means to adjust the flow of cryogenic liquid into said chamber.

3. Apparatus according to claim 1 having temperature sensing means in said chamber adjacent the downstream end thereof which is connected to said control means, said control means operating said first variable speed drive means to assure a sufficient low temperature is achieved adjacent the downstream end of said chamber.

4. Apparatus according to claim 1 having second product inlet means providing for the simultaneous introduction of particles at two different locations.

5. Apparatus according to claim 1 having grinding means downstream of said outlet means to receive cooled particulate material therefrom and grind the cooled particulate material.

6. Apparatus according to claim 5, having discharge temperature sensing means, connected to said control means, in the discharge side of said grinding means, said control means being adapted to operate said first variable speed drive means to assure a sufficiently low temperature at the discharge side of said grinding means.

7. Apparatus according to claim 5 including means associated with said grinding means for measuring grinding resistance in said grinding means, said measuring means being connected to said control means and said control means being adapted to operate said feed auger drive means so as to prevent excess grinding resistance in said grinding means.

8. Apparatus according to claim 7 wherein said measuring means measures grinding resistance by the amperage supplied to said grinding means.

9. Apparatus according to claim 5 wherein said grinder is an impact grinder.

10. Apparatus according to claim 5 wherein said grinding means includes grate means which allow particulate material of a predetermined mesh to pass therethrough.

11. Apparatus according to claim 1 wherein said first variable speed drive means is operable to rotate said feed auger shaft in either rotational direction, said feed auger blade feeding particulate material downstream when said feed auger shaft is rotated in one direction and retaining particulate material in said chamber when said feed auger shaft is rotated in the other direction.

12. Apparatus according to claim 1 having valve means in said inlet means for controlling the input of particulate material.

13. Apparatus according to claim 1 having vent means allowing for the escape of gasses from said chamber.

14. Apparatus according to claim 13 having means in said vent means for preventing the escape of particulate material from said chamber.

15. Apparatus according to claim 1 wherein said chamber is encased in an insulated outer shell.

16. Apparatus in accordance with claim 1 wherein said cryogenic liquid inlet means comprises a needle valve means having a restricted orifice and a valve member which reciprocates to open and close said restricted orifice in response to the pressure of cryogenic liquid supplied to said needle valve means.

17. Apparatus in accordance with claim 1 wherein said cryogenic liquid inlet means comprises a valve means having a porous throttling member to disperse a stream of liquid supplied to said valve means.

18. Apparatus in accordance with claim 17 wherein said throttling member is formed of sintered metal.

19. Apparatus in accordance with claim 1 wherein said inlet means comprises a manifold and a plurality of nozzles extending therefrom.

20. Apparatus for mixing and cooling particulate material comprising an elongated mixing chamber having particulate material inlet means, cryogenic liquid inlet means connected to a supply of cryogenic liquid and disposed downstream of said particulate material inlet means to spray cryogenic liquid on the particulate material and particulate material outlet means at the downstream end of said chamber through which cooled particulate material is delivered, feed auger means having a shaft and a blade supported thereby, said feed auger means being disposed in said chamber and rotatable about an axis to move cooled particulate material through said chamber and through said outlet means, intromitter auger means coaxial with said feed auger means having a shaft rotatable independently of the rotation of said feed auger shaft and a blade supported by said intromitter auger shaft and disposed around said feed auger blade, first variable speed drive means connected to said feed auger shaft to rotate the same, second variable speed drive means connected to said intromitter auger shaft to rotate the same, said second variable speed drive means being operable to rotate said intromitter auger means in either rotational direction, a first surface of said intromitter auger blade being configured to move particles within said chamber in a downstream direction when said intromitter auger shaft is rotated in a first direction and a second surface of said intromitter auger blade being configured to move particles within said chamber in an upstream direction when said intromitter auger shaft is rotated in a second direction, control means is connected to said first variable speed drive means for operating said first drive means during certain times at a desired feed rate and for operating said first drive means during other times to prevent feeding of particulate material when additional residence time of particulate material within said mixing chamber is required, and is also connected to said second variable speed drive means for operating said second drive means independently of said first drive means, providing for independent adjustment of the speed and direction of rotation of said feed auger means and said intromitter auger means;

temperature sensing means in said chamber adjacent the downstream end thereof which is connected to said control means, said control means operating said feed auger drive means to assure a sufficient low temperature is achieved adjacent the downstream end of said chamber;

grinding means downstream of said outlet means to receive cooled particulate material therefrom and grind the cooled particulate material;

discharge temperature sensing means, connected to said control means, in the discharge side of said grinding means, said control means being adapted to operate said feed auger drive means to assure a sufficiently low temperature at the discharge of said grinding means; and means associated with said grinding means for measuring grinding resistance in said grinding means, said measuring means being connected to said control means and said control means being adapted to operate said feed auger drive means so as to prevent excess grinding resistance in said grinding means.

21. Apparatus for mixing and cooling particulate material comprising an elongated mixing chamber having particulate material inlet means, cryogenic liquid inlet means connected to a supply of cryogenic liquid and disposed downstream of said particulate material inlet means to spray cryogenic liquid on the particulate material and particulate material outlet means at the downstream end of said chamber through which cooled particulate material is delivered, feed auger means having a shaft and a blade supported thereby, said feed auger means being disposed in said chamber and rotatable about an axis to move cooled particulate material through said chamber and through said outlet means, intromitter auger means coaxial with said feed auger means having a shaft rotatable independently of the rotation of said feed auger shaft and a blade supported by said intromitter auger shaft and disposed around said feed auger blade, first variable speed drive means connected to said feed auger shaft to rotate the same, said first variable speed drive means being operable to rotate said feed auger in either rotational direction feeding particulate material downstream when operated in one direction and retaining particulate material in said chamber when operated in the other direction, second variable speed drive means connected to said intromitter auger shaft to rotate the same, said second variable speed drive means being operable to rotate said intromitter auger means in either rotational direction, a first surface of said intromitter auger blade being configured to move particles within said chamber in a downstream direction when said intromitter auger shaft is rotated in a first direction and a second surface of said intromitter auger blade being configured to move particles within said chamber in an upstream direction when said intromitter auger shaft is rotated in a second direction, control means is connected to said first variable speed drive means for operating said first drive means during certain times at a desired feed rate and for operating said first drive means during other times to prevent feeding of particulate material when additional residence time of particulate material within said mixing chamber is required, and is also connected to said second variable speed drive means for operating said second drive means independently of said first drive means, providing for independent adjustment of the speed and direction of rotation of said feed auger means and said intromitter auger means, temperature sensing means in said chamber adjacent the downstream end thereof which is connected to said control means, said control means operating said feed auger drive means to assure a sufficient low temperature is achieved adjacent the downstream end of said chamber, grinding means downstream of said outlet means to receive cooled particulate material therefrom and grind the cooled particulate material, and discharge temperature sensing means in the discharge side of said grinding means which is connected to said control means so that said feed auger drive means operates to assure a sufficiently low temperature at the discharge of said grinding means.

* * * * *